US007685860B2

(12) United States Patent
Iwashita et al.

(10) Patent No.: US 7,685,860 B2
(45) Date of Patent: Mar. 30, 2010

(54) CONTROL DEVICE FOR PRESS MACHINE

(75) Inventors: Yasusuke Iwashita, Fujiyoshida (JP); Tadashi Okita, Fujiyoshida (JP); Hiroyuki Kawamura, Yamanashi (JP); Satoshi Ikai, Yamanashi (JP)

(73) Assignee: Fanuc Ltd, Minamitsuru-gun, Yamanashi (JP)

( * ) Notice: Subject to any disclaimer, the term of this patent is extended or adjusted under 35 U.S.C. 154(b) by 844 days.

(21) Appl. No.: 11/477,345

(22) Filed: Jun. 30, 2006

(65) Prior Publication Data

US 2007/0006631 A1 Jan. 11, 2007

(30) Foreign Application Priority Data

Jul. 6, 2005 (JP) ..... 2005-197435

(51) Int. Cl.
*B21D 22/00* (2006.01)
*B21D 22/02* (2006.01)
*B21J 9/18* (2006.01)

(52) U.S. Cl. ..... 72/454; 72/1; 72/453.13; 72/20.3

(58) Field of Classification Search ..... 72/351, 72/454, 1, 4–5, 453.13, 20.3, 20.4, 21.6; 100/342, 346
See application file for complete search history.

(56) References Cited

U.S. PATENT DOCUMENTS 4,540,087 A * 9/1985 Mizumoto ..... 198/621.1
5,435,166 A * 7/1995 Sunada ..... 72/351
5,949,681 A * 9/1999 Asai et al. ..... 700/113
6,237,479 B1 * 5/2001 Douba ..... 100/43
6,338,024 B1 * 1/2002 Taniguchi et al. ..... 702/56
2003/0066323 A1 * 4/2003 Teraoka ..... 72/1
2003/0200879 A1 * 10/2003 Teraoka ..... 100/291

FOREIGN PATENT DOCUMENTS

JP 10-192997 7/1998
JP 10-202327 8/1998

* cited by examiner

*Primary Examiner*—Dana Ross
*Assistant Examiner*—Mohammad Yusuf
(74) *Attorney, Agent, or Firm*—Drinker Biddle & Reath LLP

(57) ABSTRACT

A control device for a press machine, by which one of the slide and the die cushion is suitably controlled, when a malfunction occurs in the other, such that the force between the slide and the die cushion does not excessively increase. The control device includes a slide control part for controlling the motion of the slide and a die cushion control part for controlling the motion of the die cushion. A first transmitter transmits an abnormal signal from the die cushion control part to the slide control part when a first detector detects a malfunction of the die cushion. The slide control part is configured to move the slide, when receiving the abnormal signal, such that the slide is away from the position of the die cushion at the time of receiving the abnormal signal by a certain distance and, to stop the slide.

8 Claims, 6 Drawing Sheets

CONTROL DEVICE FOR PRESS MACHINE

BACKGROUND OF THE INVENTION

1. Field of the Invention

The present invention relates to a control device, for a die cushion mechanism, which generates a force on a slide of a press machine using a servomotor as a drive source and, in particular, to a control device for controlling the force generated by the die cushion mechanism of the press machine.

2. Description of the Related Art

It is known that a press machine, for press working such as bending, drawing or punching, can be provided with a die cushion mechanism, as an attached device, for applying a predetermined force or pressure, during the press working, to a movable support member (generally called a slide) supporting a first mold for press working, the force being generated by another movable member supporting a second mold. The die cushion mechanism is generally configured such that the slide (or the first mold), moving in a mold-clamping direction, directly or indirectly collides with a movable element (generally called as a cushion pad) held at a predetermined pressure and, until the molding is finished, the cushion pad is moved with the slide while applying force or pressure to the slide. During this operation, it is possible to prevent the occurrence of wrinkles in a workpiece to be pressed by, for example, clamping an area around a site, of the workpiece, to be pressed between the cushion pad and the slide.

Many conventional die cushion mechanisms use a hydraulic or a pneumatic unit as a drive source. However, control by a hydraulic or a pneumatic unit may be carried out only under a constant pressure. It is preferable that the pressure during drawing is varied corresponding to the amount of the drawing. However, the pressure cannot be varied in a hydraulic or a pneumatic unit.

In recent years, therefore, a die cushion mechanism using a servomotor as a drive source has been used to carry out force control at high speed, as described in Japanese Unexamined Patent Publication (Kokai) No. 10-202327. In the die cushion mechanism described in this publication, a cushion pad positioned below a slide of a press machine may be upwardly and downwardly moved by a servomotor, corresponding to the rise and fall motions of the slide. The servomotor is activated by a predetermined force command corresponding to the position of the cushion pad and adjusts the force or pressure applied, to the slide, by the cushion pad while moving the cushion pad with the slide. The collision of, and pressure between, the slide and the cushion pad may be determined by detecting a load applied to an output axis of the servomotor via the cushion pad.

In the press machine using the servo die cushion having a servomotor as a drive source, a method capable of performing an interconnected control of the slide and the die cushion has not yet been developed. Accordingly, a control device for the slide and a control device for the die cushion are separately arranged and operated. For example, the slide and the die cushion are individually controlled such that each of them is positioned at a predetermined position at each instant of time. As a result, a desired press force between the slide and the die cushion may be generated. In such a control, even when an alarm informing a malfunction of one of the slide and the die cushion is detected, the other of them is controlled based on a predetermined normal position command without reference to the alarm. Therefore, the moving die cushion is immediately stopped by the alarm and, for example, the motion of the slide toward the die cushion may be continued. As this causes an excess increase of the press force, the machine may be damaged by such a control.

SUMMARY OF THE INVENTION

Therefore, an object of the present invention is to provide a control device, by which one of the slide and the die cushion is suitably controlled when a malfunction occurs in the other of them, such that the force between the slide and the die cushion does not increase excessively.

According to the present invention, there is provided a control device of a press machine having a slide and a die cushion generating a force applied to the slide by using a servomotor as a drive source, the control device comprising: a slide control part for controlling the motion of the slide; a die cushion control part for controlling the motion of the die cushion and having a first detector for detecting a malfunction of the die cushion, the die cushion control part being configured to stop the motion of the die cushion when the first detector detects a malfunction of the die cushion; and a first transmitter for transmitting an abnormal signal indicating the malfunction of the die cushion to the slide control part when the first detector detects a malfunction of the die cushion; wherein the slide control part is configured to move the slide, when receiving the abnormal signal from the first transmitter, such that the slide is away from the position of the die cushion at the time of receiving the abnormal signal by a certain distance and, to stop the slide.

It is preferable that the slide control part moves the slide along a press direction of the press machine when receiving the abnormal signal.

The slide control part may move and stop the slide at an upper dead center of the slide when receiving the abnormal signal.

The first transmitter may transmit position data of the die cushion at the time of occurrence of the malfunction to the slide control part, and the slide control part may determine the certain distance based on the position data of the die cushion.

The present invention also provides a control device of a press machine having a slide and a die cushion generating a force applied to the slide by using a servomotor as a drive source, the control device comprising: a slide control part for controlling the motion of the slide and having a second detector for detecting a malfunction of the slide, the slide control part being configured to stop the motion of the slide when the second detector detects the malfunction of the slide; a die cushion control part for controlling the motion of the die cushion; and a second transmitter for transmitting an abnormal signal indicating the malfunction of the slide to the die cushion control part when the second detector detects the malfunction of the slide; wherein the die cushion control part is configured to move the die cushion, when receiving the abnormal signal from the second transmitter, such that the die cushion is away from the position of the slide at the time of receiving the abnormal signal by a certain distance and, to stop the die cushion.

It is preferable that the die cushion control part moves the die cushion along a press direction of the press machine when receiving the abnormal signal.

The die cushion control part may move and stop the die cushion at a lower dead center of the die cushion when receiving the abnormal signal.

The second transmitter may transmit position data of the slide at the time of occurrence of the malfunction to the die cushion control part, and the die cushion control part may determine the certain distance based on the position data of the slide.

BRIEF DESCRIPTION OF THE DRAWINGS

The above and other objects, features and advantages of the present invention will be made more apparent by the following description of the preferred embodiments thereof, with reference to the accompanying drawings wherein.

DETAILED DESCRIPTION

The present invention is explained below with reference to the drawings.

Figure 1:
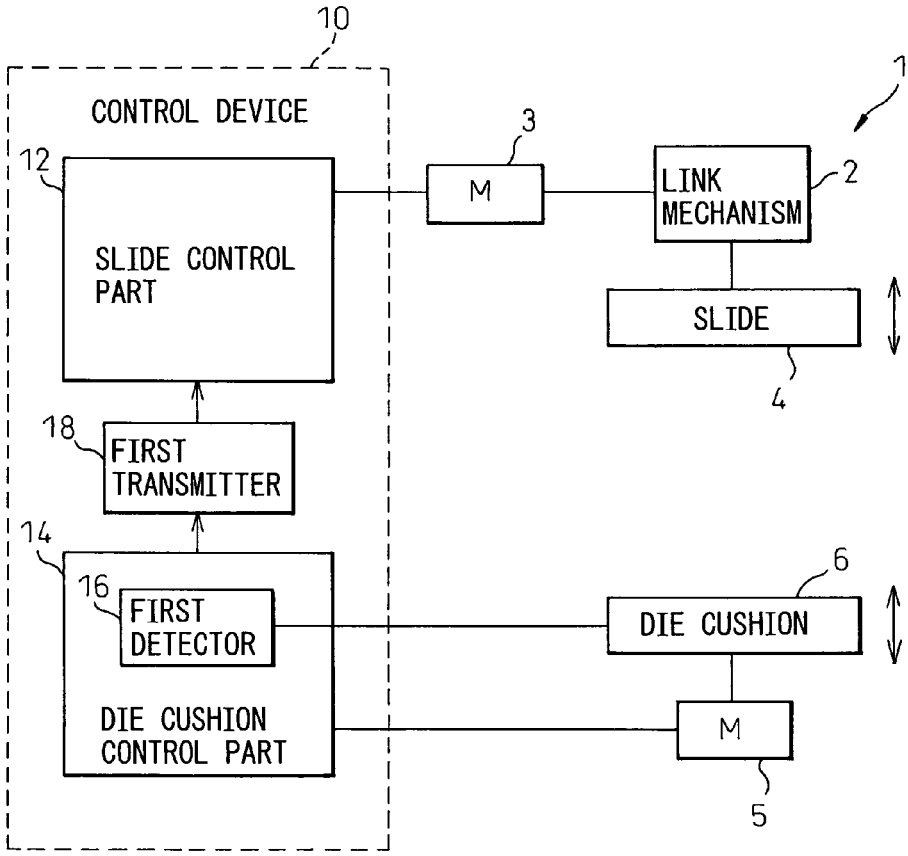
FIG. 1 is a functional block diagram of a control device according to a first embodiment of the invention.

As shown in FIG. 1, a control device 10 according to a first embodiment of the invention is used to control a press machine 1 having a slide 4 driven by a servomotor 3 via a suitable link mechanism 2 and a die cushion mechanism 6 capable of moving corresponding to the motion of the slide 4 by means of a servomotor 5. The control device 10 has a slide control part 12 and a die cushion control part 14 for controlling the servomotors 3 and 5, respectively, so as to generate a predetermined press force or pressure between the slide 4 and the die cushion 6.

As shown in FIG. 1, the die cushion control part 14 includes a first detector 16 for detecting a malfunction of the die cushion 6. When the first detector 16 detects the malfunction of the die cushion 6, the die cushion control part 14 immediately stops the motion of the die cushion 6 for safety. The control device 10 also includes a first transmitter 18 for transmitting an abnormal signal indicating the malfunction of the die cushion 6, from the die cushion control part 14 to the slide control part 12, when the first detector 16 detects the malfunction. As described below, the slide control part 12 is configured to move the slide 4, when receiving the abnormal signal from the first transmitter 18, such that the slide 4 is away from the position of the die cushion 6 at the time of receiving the abnormal signal by a certain distance and, to stop the slide 4. In addition, the direction of the movement of the slide 4 is preferably along a press direction of the press machine, i.e., a normal direction of the motion of the slide. Hereinafter, a function of the control device 10 is explained with reference to FIGS. 2 and 3.

Figure 2:
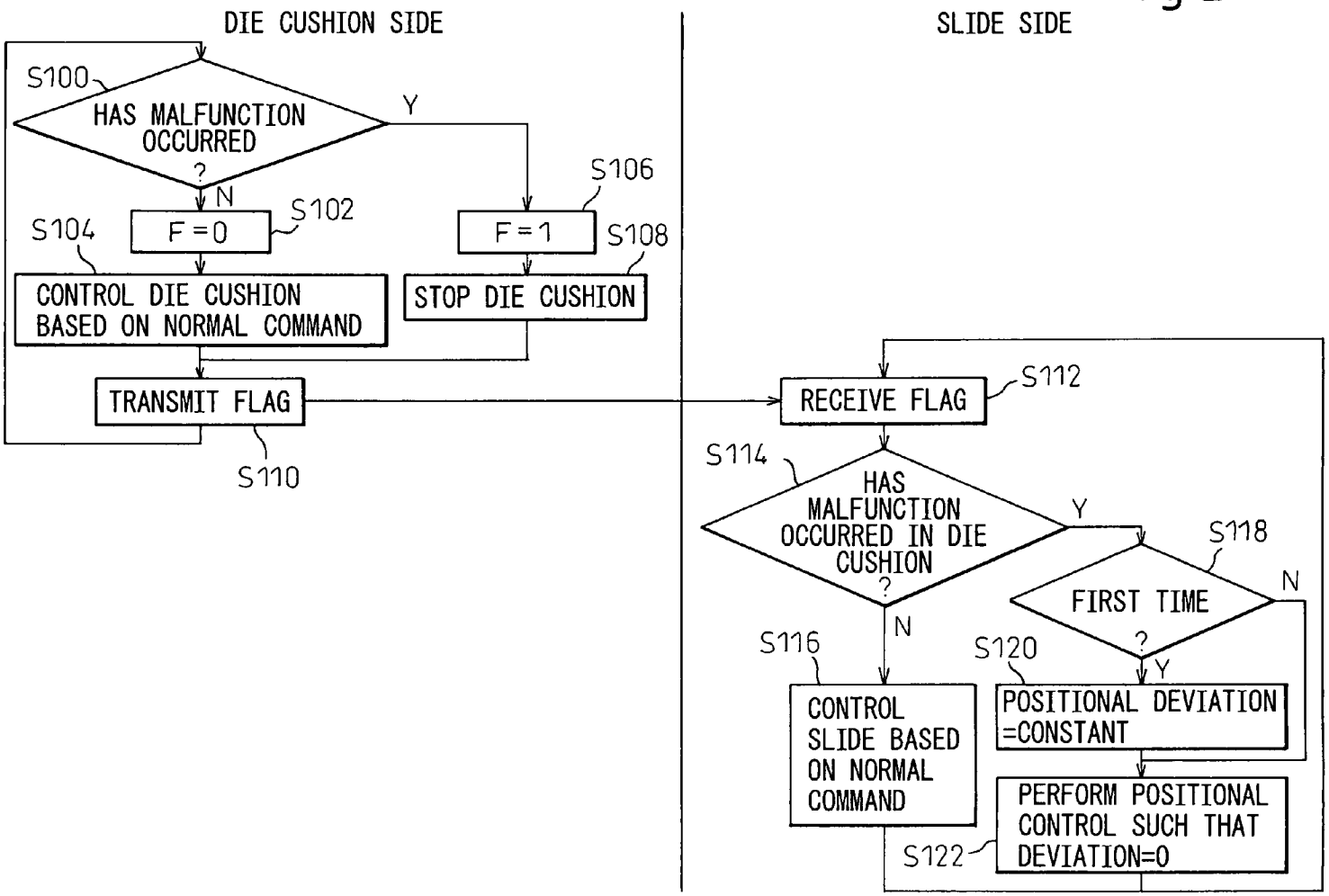
FIG. 2 is a flowchart of a function of the control device of the first embodiment.

First, as shown in FIG. 2, in the die cushion control part 14, it is judged whether a malfunction of the die cushion 6 has occurred or not (step S100). When the malfunction is not detected, a flag F indicating a status of the malfunction is set to zero (step S102) and, then, the die cushion 6 is driven by a normal press command (step S104). On the other hand, if the malfunction of the die cushion 6 is detected in step S100, the flag F is set to 1 (step S106) and, then, the die cushion 6 is immediately stopped (step S108). After step S104 or S108, an abnormal signal including the flag F is transmitted from the die cushion control part 14 to the slide control part 12 (steps S110 and S112).

Next, the slide control part 12 judges the malfunction of the die cushion 6 based on the above abnormal signal (step S114). When the malfunction has not occurred, the motion of the slide 4 is controlled based on a normal press command (step S116). On the other hand, if the malfunction of the die cushion 6 occurs, it is judged whether this check of the abnormal signal is the first time or not (step S118). If it is the first time, a positional deviation for determining the position, where the slide 4 is to be moved, is set to a predetermined constant value (step S120). This constant value is preset such that the slide 4 is away from the die cushion 6 stopped by a malfunction until the force generated between them is equal to zero or a suitable low value. The constant value may be set based on experiment or experience, otherwise, it may be calculated by a simulation. Next, in step S122, the positional control of the slide 4 is performed based on the positional deviation (i.e., the constant value). In addition, when the check of the abnormal signal is the second or a later time in step S118, it is not necessary to set the positional deviation. Therefore, the procedure skips step S120 and progresses to step S122.

Instead of performing the positional control of the slide explained in relation to steps S118 to S122, the slide may be moved to a safe position, such as an upper dead center of the slide, when a malfunction of the die cushion occurs. In this case, steps S118 to S122 are replaced with another step including the command "move slide to upper dead center".

In the flowchart as shown in FIG. 2, the slide control part 12 moves the slide 4 away from the die cushion 6 without detecting the position of the die cushion 6 stopped by a malfunction. Accordingly, the above positional deviation is intended to be set to a relatively large value for safety. Given this factor, by configuring the above first transmitter 18 such that the transmitter can send the positional data of the die cushion 6 at the time of occurrence of a malfunction to the slide control part 12, the slide control part 12 may determine the positional deviation based on the positional data of the die cushion 6. In other words, if the position of the die cushion at the time of occurrence of the malfunction is known, an undesired increase in the press force may be prevented by moving the slide 4 by a minimum necessary distance. This method is explained below with reference to FIG. 3.

Figure 3:
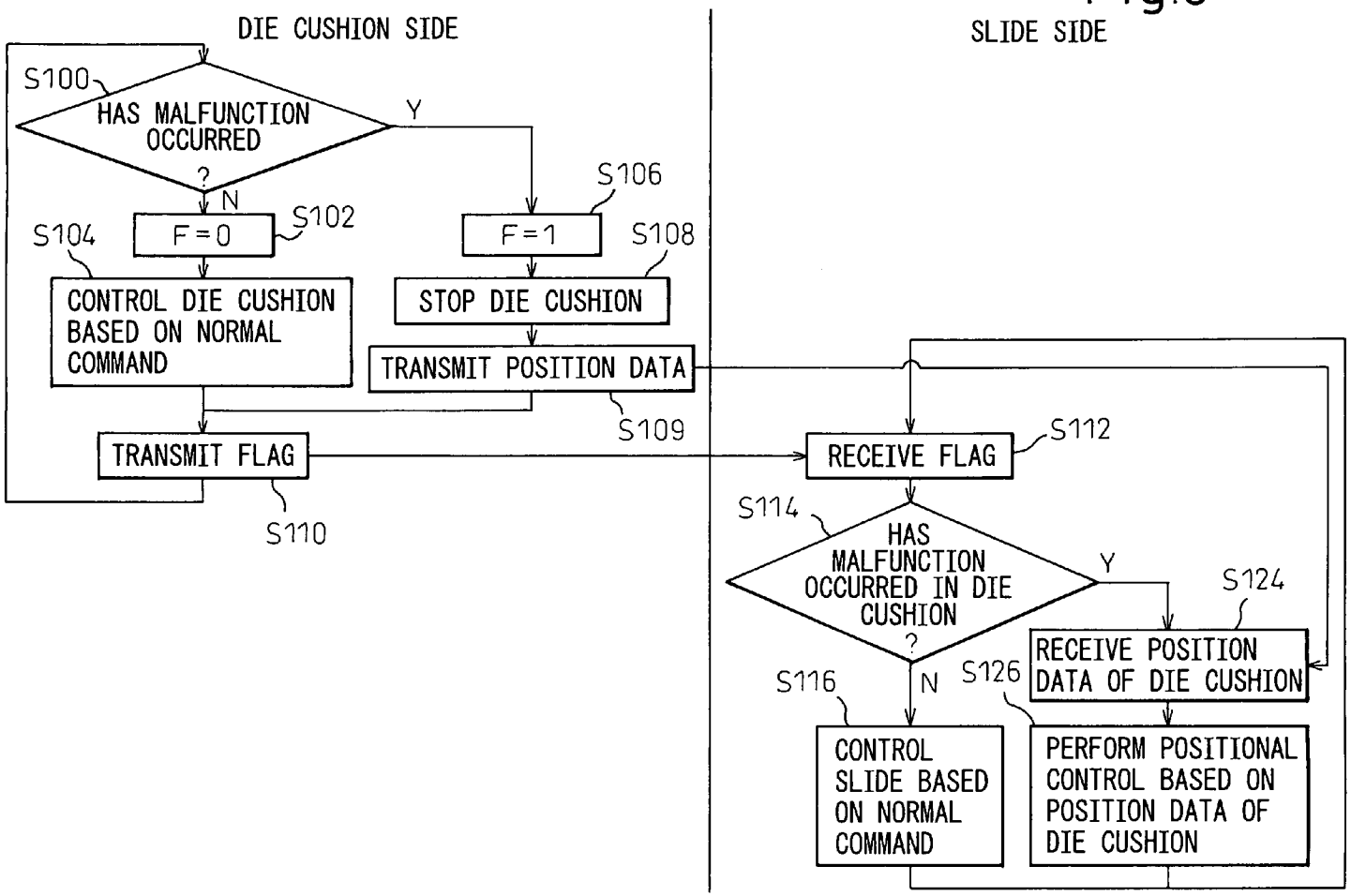
FIG. 3 is a flowchart of another function of the control device of the first embodiment.

The flowchart of FIG. 3 is different from that of FIG. 2 in that, in controlling the die cushion 6, the positional data of the die cushion is sent to the slide control part 12 (step S109) after step S108 for stopping the motion of the die cushion. The sent positional data is received by the slide control part 12 in step S124, after it is judged in step S114 that a malfunction of the die cushion occurs. Then, in step S126, the positional control (or the generation of a position command) for the slide is performed based on the current position (or the stopping position) of the die cushion 6 and a predetermined constant value. Similarly to the case of FIG. 2, the predetermined constant value is preset such that the slide 4 is away from the die cushion 6 stopped by a malfunction until the force generated between them is equal to zero or a suitable low value. In this case, however, as the position of the die cushion is known, it is not necessary to add a margin to the distance of movement of the slide. Therefore, the distance of movement of the slide may be set to a minimum necessary distance.

In the control device according to the above first embodiment, the position of the slide is suitably controlled when a malfunction of the die cushion occurs. On the other hand, in a control device according to a second embodiment, as described below with reference to FIGS. 4 to 6, the position of the die cushion is suitably controlled when a malfunction of the slide occurs.

Figure 4:
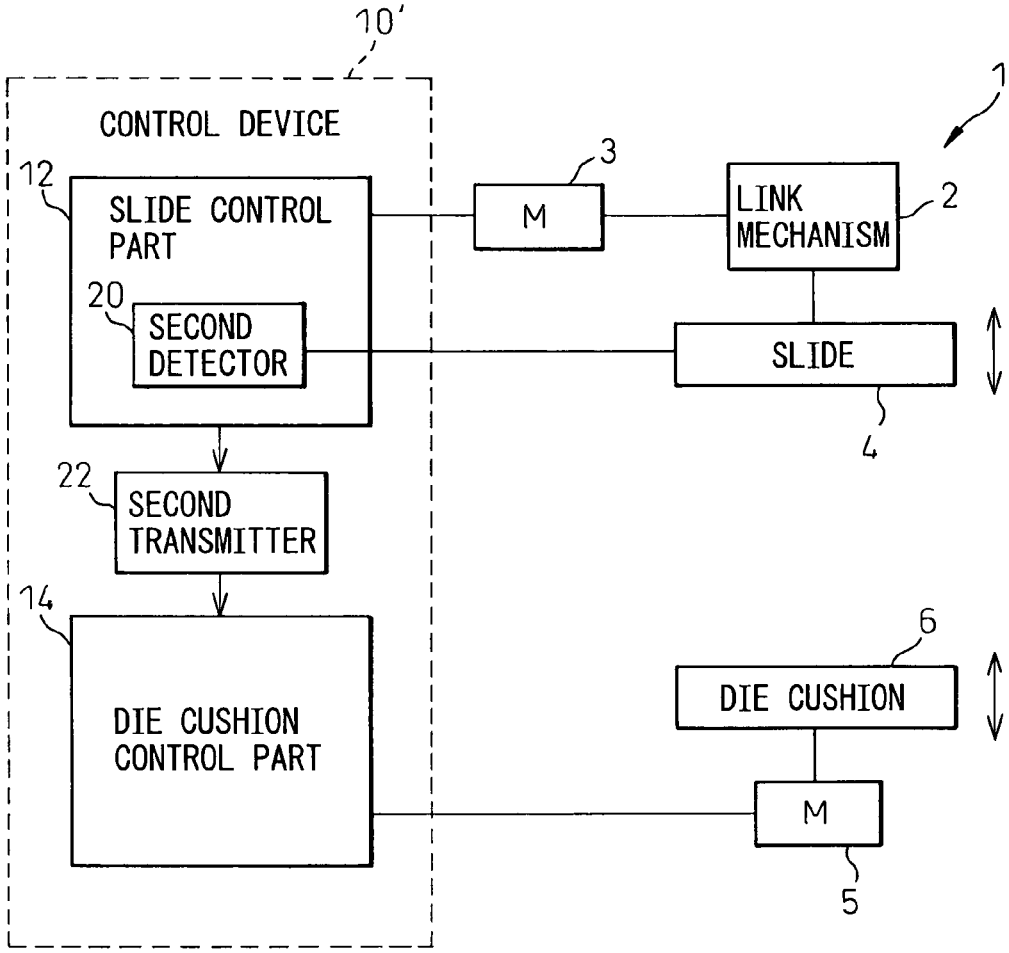
FIG. 4 is a functional block diagram of a control device according to a second embodiment of the invention.

A control device 10' of the second embodiment as shown in FIG. 4 is different from the control device 10 of the first embodiment in that a slide control part 12 includes a second detector 20 for detecting a malfunction of the slide 4. When the second detector 20 detects the malfunction of the slide 4, the slide control part 12 immediately stops the motion of the slide 4 for safety. Further, the control device 10' includes a second transmitter 22 for transmitting an abnormal signal indicating the malfunction of the slide 4, from the slide control part 12 to the die cushion control part 14, when the second detector 20 detects the malfunction. As described below, the die cushion control part 14 is configured to move the die cushion 6, when receiving the abnormal signal from the second transmitter 22, such that the die cushion 6 is away from the position of the slide 4 at the time of receiving the abnormal signal by a certain distance and, to stop the die cushion 6. In addition, the direction of the movement of the die cushion 6 is preferably along a press direction of the press machine, i.e., a normal direction of the motion of the die cushion. Hereinafter, a function of the control device 101 is explained with reference to FIGS. 5 and 6.

Figure 5:
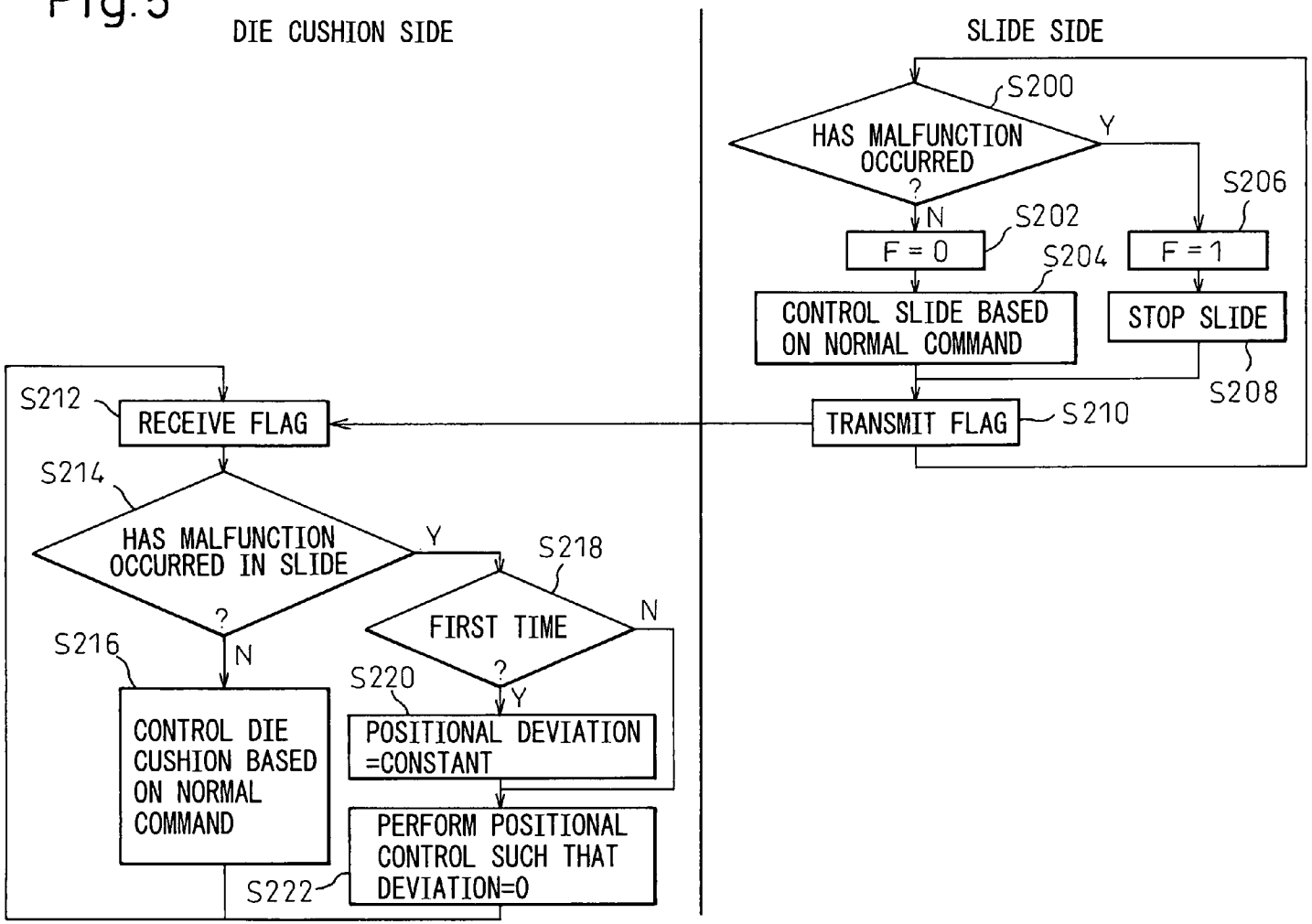
FIG. 5 is a flowchart of a function of the control device of the second embodiment.

First, as shown in FIG. 5, in the slide control part 12, it is judged whether a malfunction of the slide 4 has occurred or not (step S200). When a malfunction is not detected, a flag F indicating a status of the malfunction is set to zero (step S202) and, then, the slide 4 is driven by a normal press command (step S204). On the other hand, if the malfunction of the slide 4 is detected in step S200, the flag F is set to 1 (step S206) and, then, the slide 4 is immediately stopped (step S208). After step S204 or S208, an abnormal signal including the flag F is transmitted from the slide control part 12 to the die cushion control part 14 (steps S210 and S212).

Next, the die cushion control part 14 judges the malfunction of the slide 4 based on the above abnormal signal (step S214). When a malfunction does not occur, the motion of the die cushion 6 is controlled based on a normal press command (step S216). On the other hand, if the malfunction of the slide 4 occurs, it is judged whether this check of the abnormal signal is the first time or not (step S218). If it is the first time, a positional deviation for determining the position, where the die cushion 6 is to be moved, is set to a predetermined constant value (step S220). This constant value is preset such that the die cushion 6 is away from the slide 4, stopped by a malfunction, until the force generated between them is equal to zero or a suitable low value. The constant value may be set based on experiment or experience, otherwise, it may be calculated by simulation. Next, in step S222, the positional control of the die cushion 6 is performed based on the positional deviation (i.e., the constant value). In addition, when the check of the abnormal signal is the second or a later time in step S218, it is not necessary to set the positional deviation. Therefore, the procedure skips step S220 and progresses to step S222.

Instead of performing the positional control of the die cushion explained in relation to steps S218 to S222, the die cushion may be moved to a safe position, such as a lower dead center of the die cushion, when a malfunction of the slide occurs. In this case, steps S218 to S222 are replaced with another step including the command "move die cushion to lower dead center".

In the flowchart as shown in FIG. 5, the die cushion control part 14 moves the die cushion 6 away from the slide 4 without detecting the position of the slide 4 stopped by a malfunction. Accordingly, the above positional deviation is intended to be set to a relatively large value, for safety. Given this factor, by configuring the above second transmitter 22 such that the transmitter can send the positional data of the slide 4 at the time of occurrence of a malfunction to the die cushion control part 14, the die cushion control part 14 may determine the positional deviation based on the positional data of the slide 4. In other words, if the position of the slide at the time of occurrence of the malfunction is known, an undesired increase in the press force may be prevented by moving the die cushion 6 by a minimum necessary distance. This method is explained below with reference to FIG. 6.

Figure 6:
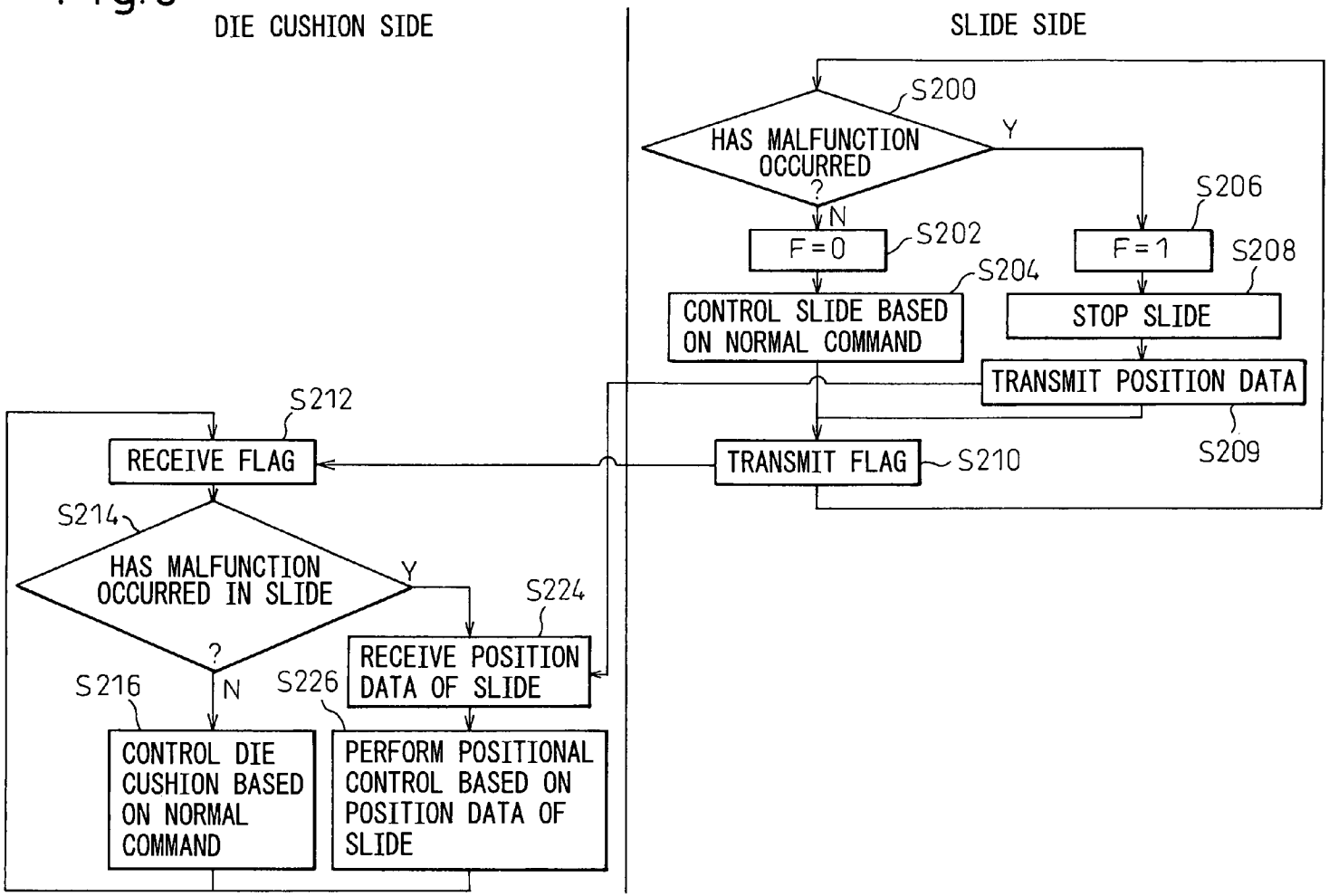
FIG. 6 is a flowchart of another function of the control device of the second embodiment.

The flowchart of FIG. 6 is different from that of FIG. 5 in that, in controlling the slide 4, positional data of the slide is sent to the die cushion control part 14 (step S209) after step S208 for stopping the motion of the slide. The sent positional data is received by the die cushion control part 14 in step S224, after it is judged in step S214 that a malfunction of the slide has occurred. Then, in step S226, the positional control (or the generation of a position command) for the die cushion is performed based on the current position (or the stopping position) of the slide 4 and a predetermined constant value. Similarly to the case of FIG. 5, the predetermined constant value is preset such that the die cushion 6 is away from the slide 4, stopped by a malfunction, until the force generated between them is equal to zero or a suitable low value. In this case, however, as the position of the slide is known, it is not necessary to add a margin to the distance of movement of the die cushion. Therefore, the distance of movement of the die cushion may be set to a minimum necessary distance.

According to the control device of the press machine of the present invention, when one of the slide and the die cushion is stopped due to a malfunction, the other may be controlled and moved such that they are away from each other. Therefore, the force between the slide and the die cushion or the press force does not excessively increase, whereby a risk that the press machine may be damaged is avoided.

While the invention has been described with reference to specific embodiments chosen for the purpose of illustration, it should be apparent that numerous modifications could be made thereto, by one skilled in the art, without departing from the basic concept and scope of the invention.

The invention claimed is:

1. A control device, of a press machine having a slide and a die cushion generating a force applied to the slide by using a servomotor as a drive source, the control device comprising:

a slide control part for controlling the motion of the slide;

a die cushion control part for controlling the motion of the die cushion and having a first detector for detecting a malfunction of the die cushion, the die cushion control part being configured to stop the motion of the die cushion when the first detector detects a malfunction of the die cushion; and a first transmitter for transmitting an abnormal signal indicating the malfunction of the die cushion to the slide control part when the first detector detects a malfunction of the die cushion;

wherein the slide control part is configured to move the slide, when receiving the abnormal signal from the first transmitter, such that the slide is away from the position of the die cushion at the time of receiving the abnormal signal by a certain distance and, to stop the slide.

2. The control device as set forth in claim 1, wherein the slide control part moves the slide along a press direction of the press machine when receiving the abnormal signal.

3. The control device as set forth in claim 1, wherein the slide control part moves and stops the slide at an upper dead center of the slide when receiving the abnormal signal.

4. The control device as set forth in claim 1, wherein the first transmitter transmits position data of the die cushion at the time of occurrence of the malfunction to the slide control part, and the slide control part determines the certain distance based on the position data of the die cushion.

5. A control device, of a press machine having a slide and a die cushion generating a force applied to the slide by using a servomotor as a drive source, the control device comprising:

a slide control part for controlling the motion of the slide and having a second detector for detecting a malfunction of the slide, the slide control part being configured to stop the motion of the slide when the second detector detects a malfunction of the slide;

a die cushion control part for controlling the motion of the die cushion; and a second transmitter for transmitting an abnormal signal indicating the malfunction of the slide to the die cushion control part when the second detector detects a malfunction of the slide;

wherein the die cushion control part is configured to move the die cushion, when receiving the abnormal signal from the second transmitter, such that the die cushion is away from the position of the slide at the time of receiving the abnormal signal by a certain distance and, to stop the die cushion.

6. The control device as set forth in claim 5, wherein the die cushion control part moves the die cushion along a press direction of the press machine when receiving the abnormal signal.

7. The control device as set forth in claim 5, wherein the die cushion control part moves and stops the die cushion at a lower dead center of the die cushion when receiving the abnormal signal.

8. The control device as set forth in claim 5, wherein the second transmitter transmits position data of the slide at the time of occurrence of the malfunction to the die cushion control part, and the die cushion control part determines the certain distance based on the position data of the slide.

* * * * *